United States Patent [19]

McMillan

[11] 4,054,691

[45] Oct. 18, 1977

[54] PROCESS FOR PROMOTING THE ADHESION OF CEMENTITIOUS MATERIAL TO CLOSED CELL GENERALLY SMOOTH SKINNED FOAM MATERIALS

[75] Inventor: William J. McMillan, Midland, Mich.

[73] Assignee: The Dow Chemical Company, Midland, Mich.

[21] Appl. No.: 617,333

[22] Filed: Sept. 24, 1975

[51] Int. Cl.[2] ..... B05D 1/36; B05D 3/12; B05D 7/02

[52] U.S. Cl. ..... 427/290; 427/322; 427/346; 427/403

[58] Field of Search ..... 427/403, 290, 407, 57, 427/346, 322; 428/158, 159, 160, 310, 139

[56] References Cited

U.S. PATENT DOCUMENTS

| | | | |
|---|---|---|---|
| 2,294,247 | 8/1942 | Smith | 427/403 |
| 2,335,959 | 12/1943 | Patch | 427/403 X |
| 3,043,790 | 7/1962 | Sanders | 260/23.7 R X |
| 3,512,327 | 5/1970 | La Padura | 428/310 X |
| 3,592,724 | 7/1971 | King et al. | 428/310 X |

FOREIGN PATENT DOCUMENTS

| | | | |
|---|---|---|---|
| 343,617 | 12/1959 | Switzerland | 428/159 |
| 998,094 | 7/1965 | United Kingdom | 428/310 |
| 941,023 | 11/1963 | United Kingdom | 428/310 |

*Primary Examiner*—James R. Hoffman
*Attorney, Agent, or Firm*—Ronald G. Brookens

[57] ABSTRACT

A process for promoting the adhesion of cementitious material to the surface of closed cell generally smooth skinned foam materials which process comprises the sequential steps of (1) applying to the foam surface a substantially continuous first coating of a thermoplastic styrene-butadiene-1,3 copolymer having a styrene to butadiene weight ratio of about 30:70 to 70:30, and based on the weight of said copolymer, (a) from about 2 to about 10 percent of non-ionic surfactant, (b) from about 0.75 to 7.5 percent of anionic surfactant, at least about 15 percent of which is a sodium alkyl sulfate in which the alkyl group contains 9 to 17 carbon atoms, the sum of (a) and (b) not exceeding about 11 percent by weight of said copolymer and the weight ratio of (a) to (b) being within the range of about 0.7:1 to 10:1, then (2) applying an aqueous hydraulic cementitious material to the coated surface prior to substantial dehydration of said first coating, and (3) allowing said cementitious material to harden. Such process is particularly adapted for the preparation of delamination resistant composite panels for use in building construction.

5 Claims, No Drawings

PROCESS FOR PROMOTING THE ADHESION OF CEMENTITIOUS MATERIAL TO CLOSED CELL GENERALLY SMOOTH SKINNED FOAM MATERIALS

BACKGROUND OF THE INVENTION

In the application of cementitious materials to closed cell generally smooth skinned foam materials such as styrene polymer foams, difficulty is experienced in obtaining an adequate and permanent bond between the contacting surfaces of the dissimilar materials. This is due at least in part to the fact that the prior known cementitious materials in setting, tend to shrink whereas the foam surface with which it comes in contact does not undergo a corresponding shrinkage. Also, the differences between the coefficients of thermal expansion between the two types of materials often provides a severe shearing stress which results in failure of the bond between the materials.

SUMMARY OF THE INVENTION

In accordance with the present invention, the adhesion of cementitious materials to closed cell generally smooth skinned foam materials is enhanced by a process comprising the sequential steps of (1) applying to the foam surface a substantially continuous first coating of a thermoplastic styrene-butadiene copolymer latex consisting essentially of a styrene-butadiene-1,3 copolymer having a styrene to butadiene weight ratio of about 30:70 to 70:30, and based on the weight of said copolymer, (a) from about 2 to about 10 percent of non-ionic surfactant, (b) from about 0.75 to 7.5 percent of anionic surfactant, at least about 15 percent of which is a sodium alkyl sulfate in which the alkyl group contains 9 to 17 carbon atoms, the sum of (a) and (b) not exceeding about 11 percent by weight of said copolymer and the weight ratio of (a) to (b) being within the range of about 0.7:1 to 10:1, then (2) applying an aqueous hydraulic cementitious material to the coated surface prior to substantial dehydration of the first coating, and (3) allowing the cementitious material to harden.

DESCRIPTION OF PREFERRED EMBODIMENTS

The foam material employed in the practice of this invention is any closed cell generally smooth skinned foam such as the styrene polymer foams, styrene-acrylonitrile copolymer foams, styrene-methylmethacrylate copolymer foams, polyvinylchloride foams, polyurethane foams, polyethylene foams, phenolic foams and other materials available in cellular foam form which are known in the art such as the ceramic foams and foam glass.

For obtainment of optimum bonding, the surface of the foam to which the cementitious material is to be applied is provided with a plurality of indentations therein which indentations ultimately contain a portion of the cementitious material. Such indentations may be of a wide variety of shapes, sizes and frequency. More particularly, the surface of the foam may be punched, drilled, stamped, milled, routed, scored or cut to provide such indentations. Further, heated projections of varying configuration may be used to form indentations by melting a portion of such foam insulation. A particularly useful means for placing indentations in the foam is to pass the foam along a forwarding roll having longitudinal projections thereon. This method is particularly useful for placing indentations in styrene polymer foam due to the inherent resiliency of such foam material. Thus, such foam is initially compressed under a projection having a substantially square contact area, then pushed in a forward direction. The resulting combination of compression and resiliency causes the foam to tear away from the edge of the initial hole, thereby making a hole larger in diameter at the bottom than at the top. The shape of the hole thus resembles a trapezoid with the short parallel side of the hole opening at the foam surface.

The thermoplastic styrene-butadiene copolymer latex contemplated for use in applying a substantially continuous coating on the surface of the foam which is to be placed adjacent the cementitious layer consists essentially of a styrene-butadiene-1,3 copolymer having a styrene to butadiene weight ratio of about 30:70 to 70:30, and based on the weight of said copolymer, (a) from about 2 to about 10 percent of non-ionic surfactant, (b) from about 0.75 to 7.5 percent of anionic surfactant, at least about 15 percent of which is a sodium alkyl sulfate in which the alkyl group contains 9 to 17 carbon atoms, the sum of (a) and (b) not exceeding about 11 percent by weight of said copolymer and the weight ratio of (a) to (b) being within the range of about 0.7:1 to 10:1. This latex is of the type as described in U.S. Pat. No. 3,043,790, issued July 10, 1962 and can be prepared in accordance with known procedures. For example, the styrene and butadiene monomers can be mixed in the proportions corresponding to the composition of the desired copolymer in water containing an emulsifying agent or agents and heated with agitation in the presence of a peroxide catalyst to initiate copolymerization. The latex coating is preferably not substantially dehydrated prior to application of the cementitious layer.

The cementitious layer utilized by the present invention may be any hydraulic cement inclusive of any of the "portland cement" materials. Optimum results are obtained, however, by utilization of a cementitious material comprised essentially of an admixture of a shrinkage compensating portland cement, mineral aggregate, from 5 to 25 percent based on the weight of cement of a styrene-butadiene-1,3 copolymer latex as specifically described supra, from 0.1 to 5 percent of a polyorganosiloxane foam depressant based on the weight of active polyorganosiloxane, and reinforcement to provide restraint against expansion.

The shrinkage compensating cements which may be utilized include the following:

Type K: This is a mixture of portland cement compounds, anhydrous calcium sulfoaluminate ($4CaO.3Al_2O_3.SO_3$), calcium sulfate ($CaSO_4$), and lime (CaO). The anhydrous calcium sulfoaluminate is a component of a separately burned clinker that is interground or blended with portland cement clinker. Alternatively, it may be formed simultaneously with the portland clinker compounds.

Type M: Either a mixture of portland cement, calcium aluminate cement and calcium sulfate or an interground product made with portland cement clinker, calcium aluminate clinker and calcium sulfate.

Type S: A portland cement containing a large tricalcium aluminate content and modified by an excess of calcium sulfate above usual amounts found in other portland cements.

The concentration of the styrene-butadiene-1,3 copolymer solids in the cement composition is critical for the obtainment of the desired combination of properties required by the present invention. In this regard, concentrations less than 5 percent based on the weight of cement used, do not provide improved mechanical properties such as flexibility, abrasion resistance, and adherence. Further, total latex solids concentrations in excess of 25 percent based on the weight of cement significantly reduce the mechanical properties of the composition.

Utilization of such copolymer latexes in conventional portland cement, mortar compositions is also disclosed in U.S. Pat. No. 3,043,790.

If the modified shrinkage compensating cement compositions are not properly restrained, they literally expand themselves apart so that their potential strength is seriously impaired or totally lost. In general, any conventional reinforcing material such as, for example, deformed bar, rods, or wire mesh, in the proper amounts and properly installed will provide restraint sufficient to maintain compositional strength and integrity. Fiber reinforcing materials, such as steel fibers or alkali restraint glass fibers, also provide sufficient restraint. Fibrous types can be added to the composition during the mixing stage and hence, will be evenly dispersed and become an integral constituent of the composition. These fibers are randomly oriented and will provide three dimensional restraint.

It has been found that the combination of alkali resistant glass fiber reinforcement and latex modification creates an unexpectedly beneficial effect.

It has also been found that properly restrained modified shrinkage compensating cement compositions possess significantly increased freeze-thaw resistance, flexural strengths and water absorption characteristics.

The amount of water employed in preparing the shrinkage compensating cement compositions is also important with regard to providing compositions of optimum workability. In this regard at least 25 percent water, based on the weight of expansive cement, is required with an amount from 35 to 65 percent being preferred.

Some or all of the non-ionic and anionic surfactants employed in the cement compositions can be present while effecting copolymerization of the styrene and butadiene. Ordinarily, however, it is preferred to follow the practices used in making styrene-butadiene emulsions for use in preparing latex paints. Thus, some but not necessarily all of the anionic surfactant is introduced to aid in effecting the desired dispersion and emulsification in carrying out the copolymerization of butadiene and styrene, and the non-ionic surfactant is subsequently added to stabilize the resulting polymer dispersion. The polyorganosiloxane foam depressant and such additional quantities of non-ionic surfactant and anionic surfactant, as are required to complete the cement composition, are subsequently introduced.

Illustrative of non-ionic surfactants are, for example: fatty acid esters such as glycerol monostearate, diethyleneglycol laurate, propyleneglycol monostearate, sorbitol monolaurate, and pentaerythritol monostearate, acid derivatives of ethylene oxide products such as the reaction product of six moles of ethylene oxide with one of oleic acid; condensation products of ethylene oxide with alcohols such as stearyl alcohol; and condensation products of ethylene oxide with phenols, naphthols, and alkyl phenols such as di-t-butylphenoxynonaoxyethylene-ethanol. Preferred are the condensation products of ethylene oxide with alkyl phenols.

Illustrative of anionic surfactants are, for example: the alkyl aryl sulfonates such as dodecylbenzene sodium sulfonate; sulfate derivatives of higher fatty alcohols (i.e., alcohols of at least nine carbon atoms and ordinarily not more than seventeen carbon atoms) such as sodium lauryl sulfate; the sulfonated animal and vegetable oils such as sulfonated fish and castor oils; sulfonated acyclic hydrocarbons; and the like. As pointed out heretofore, at least 15 percent of the anionic surfactant component of the cement additive of the invention should be a sodium higher alkyl sulfate such as sodium lauryl sulfate and preferably the anionic surfactant component consists of a mixture of an alkyl aryl sulfonate surfactant and such sodium alkyl sulfate.

Illustrative of the polyorganosiloxanes are the condensation products resulting from polymerization of organo silane diols, as represented by the formula

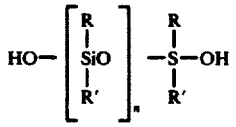

where R and R', in the above formula, represent organic radicals such as alkyl, aryl, aralkyl and alkaryl or heterocyclic groups, and n is one or more. Also useful are polymerization products of organo silane diols in the presence of an organo silane monol, and condensation products obtained from mixtures of organo silane triols, diols, and monols.

Preferably the organo substituent of the siloxanes is lower alkyl (i.e., methyl, ethyl, propyl), cyclohexyl or phenyl. Most preferably it is methyl, and accordingly, the preferred polyorganosiloxanes are those which are condensation products of methyl silicols, and most preferably condensation products of dimethyl silane diol.

Polyorganosiloxanes are commercially available in several forms which are designated in the trade as "silicone fluids", "silicone emulsions" and "silicone compounds", the latter being siloxanes modified by the addition of a small percentage of finely divided silica or other inert divided solid. Any of these forms can be used in the practice of this invention.

The aggregate employed may be conventionally employed manufactured aggregate or naturally occurring mineral aggregate, such as sand and a mixture of sand with gravel, crushed stone, or equivalent materials.

The cement compositions are made by simply adding the additives to the cement with mixing to obtain a cement mix of desired flow and consistency.

While it is generally convenient to prepare the cement compositions as a unitary product by pre-combining the styrene-butadiene copolymer, non-ionic and anionic surfactant, and polyorganosiloxane foam depressant, and then introducing the resulting mixture into the cement-aggregate mixture in making cement, mortar, or concrete mixes, it will be understood, of course, that it is not necessary that all the various components of the additive be so premixed. For example, equivalent cement, mortar, or concrete mixes are obtained by separate addition of the requisite quantity of styrene-butadiene copolymer emulsion containing sufficient of the anionic and non-ionic surfactants to avoid coagulation of the latex, the polyorganosiloxane foam depressant and such additional non-ionic and anionic surfactants as are necessary.

By way of further illustration, a plurality of blocks of closed cell generally smooth skinned polystyrene foam measuring about 1¼ inches in thickness, 2 feet in width and about 4 feet long, were forwarded along a roll having individual projections thereon, which projections were about one-half inch apart in both directions and about one-eighth inch by one-eighth inch in cross sectional area and three-sixteenths inch in height. Such projections produced a plurality of indentations in the foam which indentations were in the shape of a trapezoid with the short parallel side of the hole opening at the surface of the foam. Thereafter, the surface of the foam having such indentations was coated with a substantially continuous coating of a styrene-butadiene latex (hereinafter identified as "Latex A") composed essentially of an aqueous emulsion of about 48 weight percent of a solid copolymer of about 66 percent by weight styrene and 34 percent by weight butadiene-1,3; and based on the copolymer weight, about 4.65 percent of the non-ionic surfactant di-t-butylphenoxynonaethylene-ethanol; and about 0.78 percent of a mixture of anionic surfactants comprising predominant amounts of sodium lauryl sulfate and correspondingly lesser amounts of dodecyl-benzene sulfonate.

A one-half inch coating of a cementitious protective layer was then cast on the coated surface of the foam, prior to significant dehydration of the latex coating. The cementitious protective material used was prepared by admixing a type K shrinkage compensating cement with sufficient water to form water to cement ratios of 0.29 to 0.635, a sharp mason sand in amount to provide a sand to cement ratio of about 2.75:1, to 3:1, the styrene butadiene latex previously described as Latex A in amount to provide about 15 percent latex solids based on the weight of cement, a polymethylsiloxane foam depressant in amount to provide about 0.4 percent by weight active silicon based on the weight of latex solids, and with about 4 pounds of one-half inch long alkali-resistant glass fibers per 94 pounds of cement to furnish restraint. The Type K compensating cement was a mixture of portland cement compounds, anhydrous calcium sulfoaluminate $(CaO)_4(Al_2O_3)_3(SO_3)$, calcium sulfate $(CaSO_4)$, and lime (CaO).

The cementitious protective layer was then vibrated to remove entrapped air and to seat a portion of such cementitious layer in the indentations present in the foam.

The so-formed panels were then cured under ambient temperatures.

The cured panels were characterized by being exceptionally resistant to delamination. More particularly, delamination did not occur following 300 temperature cycles of from 15° F to 85° F or following 500 temperature cycles of from 50° F to 140° F.

The cured panels were also characterized by a freeze-thaw value of greater than 300 cycles, as determined by ASTM Test No. C-666, i.e. such panels were not significantly deteriorated following such temperature cycling.

By way of further illustration of the exceptional binding produced by the use of Latex A as prescribed by the invention, in each of a series of experiments one of a series of latex materials were cast as the substantially continuous coating on a block of a closed cell, generally smooth skinned polystyrene foam. The latex materials used were as follows:

Latex A — (as described supra)

Latex B — As per Latex A but additionally containing a polymethylsiloxane foam depressant in amount to provide about 0.4 percent by weight active silicone, based on the weight of latex solids.

Latex C (For Comparison)

A blend of (1) about 25 percent by weight of Latex A above with (2) about 75 percent by weight of a latex composed of an aqueous emulsion of about 75 percent by weight vinylidene chloride, about 20 percent by weight vinyl chloride, about 3 percent by weight ethyl acrylate and about 2 percent by weight methyl methacrylate.

Latex D (For Comparison)

As per Latex C but additionally containing small amounts of a polymethylsiloxane foam depressant.

Each coated foam sample was tested for tensile bond strength by adhering the coated foam sample between opposed wooden blocks via an epoxy adhesive. The tensile bond strength was obtained by drawing the wooden blocks apart and moving the point of separation. The following Table I illustrates the samples used and the results obtained.

Table I

| Latex Coating Used | Tensile Strength (PSI) | Type of Fracture |
|---|---|---|
| A | 73–76 | Wood to Foam |
| B | 69–70 | Film to Foam |
| C | 24–28 | Film to Foam |
| D | 25–32 | Film to Foam |

The above data illustrate the unexpectedly greater bond strength achieved using Latex A. Panels prepared as described herein are particularly useful in building construction, e.g., as roofing panels or panels used for sidewall construction.

As is apparent from the foregoing specification, the present invention is susceptible of being embodied with various alterations and modification which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto appended claims.

What is claimed is:

1. A process for promoting the adhesion of a portland cement protective covering to the surface of closed cell, generally smooth skinned styrene polymer foam material which process comprises the sequential steps of (1) providing in said foam surface a plurality of indentations therein, (2) applying to said surface a substantially continuous first coating of a thermoplastic styrene-butadiene copolymer latex consisting essentially of a styrene-butadiene-1,3 copolymer having a styrene to butadiene weight ratio of about 30:70 to 70:30, and based on the weight of said copolymer, (a) from about 2 to about 10 percent of non-ionic surfactant, (b) from about 0.75 to 7.5 percent of anionic surfactant, at least about 15 percent of which is sodium alkyl sulfate in which the alkyl groups contain 9 to 17 carbon atoms, the sum of (a) and (b) not exceeding about 11 percent by weight of said copolymer and the weight ratio of (a) to (b) being within the range of about 0.7:1 to 10:1, then (3)

applying a portland cement protective covering to the coated surface prior to substantial dehydration of said first coating, and (4) allowing said portland cement protective covering to harden.

2. The process of claim 1 wherein said indentations are generally in the shape of a trapezoid with the short parallel side of the indentation opening at the foam surface.

3. The process of claim 2 wherein said portland cement protective covering is vibrated after application to the coated foam surface as a means of seating a portion of such protective covering within said indentations.

4. The process of claim 1 wherein said portland cement protective covering consists essentially of an admixture of portland cement, mineral aggregate and from about 5 to about 25 percent based on the weight of said cement of a styrene-butadiene-1,3 copolymer having a styrene to butadiene weight ratio of about 30:70 to 70:30, water in amount of from about 25 to 65 percent based on the weight of said cement, and based on the weight of said copolymer, (a) from about 2 to about 10 percent of non-ionic surfactant, (b) from about 0.75 to 7.5 percent of anionic surfactant, at least about 15 percent of which is a sodium alkyl sulfate in which the alkyl group contains 9 to 17 carbon atoms, and (c) from about 0.1 to 5 percent of a polyorganosiloxane foam depressant based on the weight of active polyorganosiloxane, the sum of (a) and (b) not exceeding about 11 percent by weight of said copolymer and the weight ratio of (a) to (b) being within the range of about 0.7:1 to 10:1.

5. The process of claim 4 wherein said portland cement is a shrinkage compensating cement.

* * * * *